US010738468B2

(12) United States Patent
Scherrer et al.

(10) Patent No.: US 10,738,468 B2
(45) Date of Patent: Aug. 11, 2020

(54) FALSE CEILING COMPRISING MEANS FOR WEDGING PANEL(S) AND METHOD FOR CREATING SUCH A FALSE CEILING

(71) Applicant: NORMALU, Kembs (FR)

(72) Inventors: Jean-Marc Scherrer, Riedisheim (FR); Edwin Kouijzer, Valence D'Agen (FR)

(73) Assignee: NORMALU, Kembs (FR)

( * ) Notice: Subject to any disclaimer, the term of this patent is extended or adjusted under 35 U.S.C. 154(b) by 0 days.

(21) Appl. No.: 16/317,255

(22) PCT Filed: Jul. 13, 2017

(86) PCT No.: PCT/FR2017/051933

§ 371 (c)(1),
(2) Date: Jan. 11, 2019

(87) PCT Pub. No.: WO2018/011530

PCT Pub. Date: Jan. 18, 2018

(65) Prior Publication Data

US 2019/0292782 A1 Sep. 26, 2019

(30) Foreign Application Priority Data

Jul. 13, 2016 (FR) ..... 16 56753

(51) Int. Cl.
*E04B 9/24* (2006.01)
*E04B 9/00* (2006.01)
(Continued)

(52) U.S. Cl.
CPC ..... *E04B 9/242* (2013.01); *E04B 9/006* (2013.01); *E04B 9/04* (2013.01); *E04B 9/18* (2013.01); *E04B 2009/0492* (2013.01)

(58) Field of Classification Search
CPC . E04B 9/242; E04B 9/18; E04B 9/006; E04B 9/04; E04B 2009/0492
See application file for complete search history.

(56) References Cited

U.S. PATENT DOCUMENTS 4,769,965 A 9/1988 Shaub
5,782,551 A * 7/1998 Capaul ..... B32B 15/14 362/148
7,685,786 B2 3/2010 Cousin

FOREIGN PATENT DOCUMENTS

DE 9109410 U1 9/1991
DE 102014113059 A1 3/2016
(Continued)

OTHER PUBLICATIONS

International Search Report for patent application PCT/FR2017/051933 dated Sep. 22, 2017.

*Primary Examiner* — Patrick J Maestri
(74) *Attorney, Agent, or Firm* — Bachman & LaPointe, P.C.

(57) ABSTRACT

A false ceiling comprising a bearing structure comprising at least two coplanar and mutually parallel opposite profile members fixed to a ceiling, the profile members between them defining an access opening providing access to the ceiling, each profile member comprising a shoulder defining a horizontal bearing surface facing towards the ceiling, at least one panel positioned between the profile members, the panel being dimensioned to rest on the bearing surface of the profile members, the false ceiling further comprising removable and attached wedging means for transversely wedging the panel between two opposite profile members, the wedging means being arranged on either side of the panel.

15 Claims, 1 Drawing Sheet

(51) Int. Cl.
*E04B 9/04* (2006.01)
*E04B 9/18* (2006.01)

(56) References Cited

FOREIGN PATENT DOCUMENTS

| | | | |
|---|---|---|---|
| EP | 1783292 | A1 | 5/2007 |
| WO | 2014131988 | A1 | 9/2014 |

* cited by examiner

FALSE CEILING COMPRISING MEANS FOR WEDGING PANEL(S) AND METHOD FOR CREATING SUCH A FALSE CEILING

BACKGROUND OF THE INVENTION

The invention concerns the field of false walls, and in particular that of suspended false ceilings.

The invention concerns more particularly a false ceiling comprising a bearing structure capable of carrying a stretched canvas and at least one panel such as a luminous panel.

It is known to use false ceilings to hide technical elements such as electrical cables, pipes, etc. in a room.

Suspended false ceilings are made in the classic way using removable planar rails and slabs with a stretched canvas. More specifically, rows of rails are positioned in two perpendicular directions in order to define a grid. The slabs are placed in support on the rails, between each of the rows of rails.

However, in some buildings, it may be that the ceilings already have a structure in the form of parallel and opposite equidistant rails for fixing technical elements or their passage. The construction of a false ceiling, and in particular the installation of rails intended to support the panels or slabs, is then constrained by the presence of existing rails as well as by the transverse distance separating them from each other. It is therefore necessary to fix in advance the profile members intended to receive the stretched fabric on the existing rails and then to fix the fabric on them and thus form the slab.

This raises the problem of installing a slab that must include a panel. In some cases, panels with lighting means, such as light-emitting diodes, insulating panels or any other panel suitable for the expected functionality of the slab, are permanently integrated into the slab.

An example of such a slab is described in request WO2014/131988.

The fact that the profile members must be fixed to the existing rails requires that the panels must be removable in order to allow access to the space between the ceiling and the tile. The technical problem is therefore to mount a panel between two parallel profile members already installed and to ensure its retention between the profile members while giving the latter a removable character. In addition to this problem, there is the problem of ensuring a satisfactory aesthetic result when the removable panel to be installed is a luminous panel. Any shadows cast on the canvas below the light panel should be kept to a minimum.

The patent application DE102014113059 also includes a false ceiling with a panel fixed to two boom bodies by means of elastic retaining profile members. Each holding profile has means for attaching to one of the boom bodies and an elastic arm that exerts such a force on the panel that the panel is held against a support area of the boom body. This solution cannot be easily implemented when using rails and profile members already installed on walls or walls. In addition, the panel installation maneuvers are made difficult by the need to apply a transverse compression force to the elastic arm.

SUMMARY OF THE INVENTION

The invention aims to remedy these problems by proposing a false ceiling and an installation process to solve the problems referred to above.

Thus, the purpose of the invention is to provide a false ceiling that allows a panel to be quickly, easily and safely installed and removed while limiting the shadow cast on the canvas when the panel is a luminous panel.

For this purpose, and according to a first aspect, the invention proposes a false ceiling comprising a bearing structure comprising at least two opposed profile members coplanar and mutually parallel fixed on a ceiling, these profile members defining between them an access opening to the ceiling, each profile comprising a shoulder defining a horizontal bearing surface facing towards the ceiling, at least one panel disposed between the profile members, the panel being dimensioned to rest on the bearing surface of the profile members, the false ceiling further comprising removable and separately applied means for transverse wedging of the panel between two opposite profile members, these wedging means being positioned on either side of the panel.

Thanks to the presence of the wedging means and their arrangement, the panels are held on the shoulders by simple gravity, while being prevented from falling due to improper handling of the latter or their displacement in relation to the profile members, regardless of the dimensions of the shoulders on which the panels rest. The wedging means can also have the advantage of ensuring a centred positioning of the panels in relation to the profile members.

Advantageously, the wedging means are placed in vertical support on the support surfaces of the profile members.

Advantageously, each cushioning means is interposed transversely between a side edge of the panel and a vertical bearing surface of an associated profile facing towards the opposite profile.

Advantageously, the wedging means has a nominal transverse width based on the width of the panel and the width of the ceiling access opening so as to prevent transverse movement of the panel such that one of the side edges of the panel is positioned opposite the passage opening, the panel having a width greater than the width of the ceiling access opening. The wedging means are thus positioned to prevent transverse movement of the panel on the profile members, except for a clearance necessary to allow rapid installation of the panel on the profile members and their removal by simple pushing.

Advantageously, each cushioning means is a cushioning bar whose elongate body is vertically supported along a bearing surface of an associated profile, and which is interposed transversely between a side edge of the panel and a vertical bearing surface of the associated profile facing the opposite profile.

Advantageously, the wedge bar has at least one elongate planar bottom face capable of being supported along a bearing surface of an associated profile.

Advantageously, the wedge bar is of rectangular or square cross-section so as to have two opposed elongate planar side walls suitable for transverse interposition between a side edge of the panel and a vertical bearing surface of the associated profile facing the opposite profile.

Advantageously, the shoulders of the profile members define a bearing surface having a transverse width greater than or equal to 5 mm so as to limit the shadow cast on the canvas placed under the panel when the latter is a luminous panel while ensuring the maintenance of the panel via the presence of wedging means.

Advantageously, the bearing surfaces of the profile members are located at the same height.

Advantageously, the profile members, with their triangular cross-section, have a notch at the top, the intersection of two sides of the notch defining the shoulder.

Advantageously, the panel has luminous means.

Advantageously, the false ceiling has a stretched fabric fixed in the lower part of the profile members, extending parallel to the panel.

The invention also concerns a method for installing a panel on a ceiling provided with an existing structure for the construction of a false ceiling, the existing structure comprising at least two opposite, coplanar and parallel rails, the method comprising the steps of:

a) fixing a profile on each rail, each profile defining with the profile fixed to an opposite rail an access opening to the ceiling, each profile including a shoulder defining a horizontal bearing surface facing towards the ceiling, b) insert at an angle a panel with a cross section greater than the width of the access opening into the space above the profile members and bounded by the ceiling, c) place at least one removable wedging means attached to a bearing surface of one of the profile members, d) place the panel on the support surfaces.

It may be expected that step b) of placement will be performed before or after step b) of insertion.

Advantageously, the process includes a step d) consisting of placing at least one other removable wedging means attached to a bearing surface of the other of the profile members.

BRIEF DESCRIPTION OF THE DRAWINGS

Other objects and advantages of the invention will appear in the following description, with reference to the attached drawings, in which.

DETAILED DESCRIPTION

For the understanding of the description and claims, the transverse orientation corresponding substantially to the horizontal orientation of the panel in position, and the longitudinal orientation according to the horizontal direction orthogonal to the plane of the figures, shall be designated.

Figure 1:
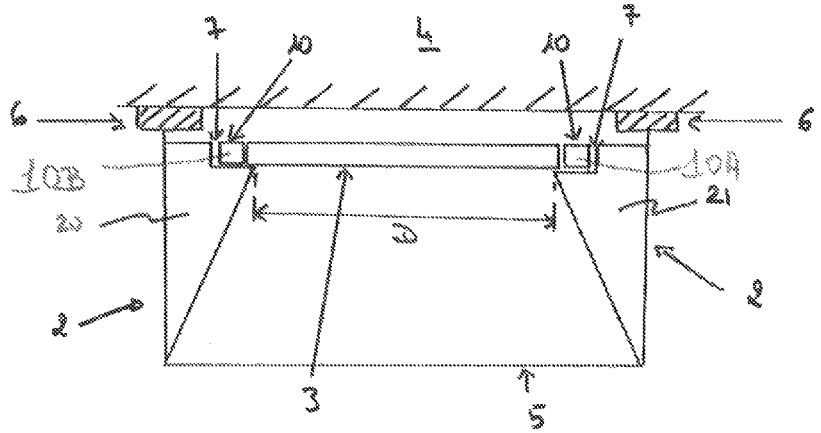
FIG. 1 shows a schematic view of a false ceiling according to an example of the realization of the invention.

In connection with FIG. 1, it is described a false ceiling 1 comprising a bearing structure 2, at least one panel 3, advantageously bright, a stretched canvas 5 and means to fix the panel 3 on the bearing structure 2.

Support structure 2 comprises a series of profile members 20, 21 mutually parallel, preferably equidistant from each other, fixed on a ceiling 4. In the example shown, only two transversely opposite profile members 20, 21 are shown. Profiles 20, 21 are fixed to the ceiling 4 via rails 6 carried by the ceiling 4. As will be seen below, when describing the installation of light panel 3, these rails are part of an existing ceiling structure.

Profiles 20, 21 are coplanar and extend mutually parallel. They are symmetrical with respect to each other and are positioned together to define a ceiling access opening 4 of transverse width "D".

In the described design mode, each profile 20, 21, of triangular cross-section, has an upper horizontal surface 200, 210, the other two surfaces defining an inner surface 201, 211 inclined and an outer vertical surface 202, 212 of the bearing structure 2.

The inner surface of one profile 20, 21 refers to the surface facing on the side of the access opening and facing the other opposite profile, and the outer surface refers to the surface opposite the inner surface.

At the junction of the upper surface 200, 210 and the inner surface 201, 211 of profile 20, 21, each profile 20, 21 has a notch 7 at right angles, extending along profile 20, 21. Preferably, notch 7 extends over the full length of profile 20, 21.

Notch 7 is thus in the form of a longitudinal groove with a right-angled cross-section similar to an "L" profile.

Notch 7 defines a shoulder on which panel 3 will rest vertically downward for installation on profile members 20, 21. In the mode of construction shown, each profile 20, 21 has a notch 7 positioned to define a shoulder with a horizontal bearing surface 8 defining a horizontal bearing plane facing towards the ceiling 4. The bearing surfaces 8 of each of the profile members 20, 21 extend in the same plane parallel to the plane of the ceiling 4.

To do this, panel 3 is sized to rest on the horizontal bearing surface 8 of each profile 20, 21. Thus, it has a transverse width greater than the transverse width "D" of the ceiling access opening, which, in the mode of execution shown, corresponds to the distance D separating the free edges opposite the shoulders.

Preferably, each shoulder has a horizontal bearing surface with a width of 5 mm or more. This has the advantage of limiting the shadow cast on canvas 5 when panel 3 carried by profile members 20, 21 is a luminous panel. Due to the narrow shoulders, panel 3 rests on them only a few millimetres. In order to prevent panel 3 from shifting transversely, and therefore not falling because it is no longer held at one of the shoulders, wedging means 10 are placed on the shoulder of each of the profile members 20, 21, between a side edge 30 of panel 3 and a vertical stop face 9 defining notch 7.

In other words, each notch 7 is delimited by a horizontal bearing surface 8, and a vertical bearing or stopping surface 9.

In the example described, each cushioning means 10 consists of an elongate cushioning bar 10A, 10B.

Each wedge bar is, for example, a straight elongate bar with a rectangular or square cross-section.

In order to ensure that panel 3 is held in place on bearing structure 2, by preventing the panel 3 from moving transversely with respect to profile members 20, 21, or at least by leaving only a clearance that does not allow the panel 3 to move transversely towards one of the profile members 20, 21 with a risk of disengagement at the opposite profile 21, 20, the wedging means 10, here consisting of one or two wedging bars, are appropriately dimensioned.

Each 10A, 10B wedge bar is thus a removable insert component that can be placed in an associated notch 7.

For this purpose, each cushion bar has at least one planar bottom surface 11 which is capable of resting vertically on an associated horizontal bearing surface 8.

Each cushion bar is also delimited by two opposite vertical side faces 12 and 13.

In position in a notch 7, and after mounting panel 3, the outer vertical side face is facing or in contact with a vertical surface 9, while the inner vertical face 13 is facing or in contact with a side edge 30 of panel 3.

Panel 3 is placed on support structure 2 as follows (the movements used to install panel 3 are represented by solid arrows).

First, first wedging means consisting of a first wedge bar 10A are installed in notch 7 of one 21 of the profile members 20, 21, on the corresponding horizontal bearing surface 8 for associated.

Figure 2A:
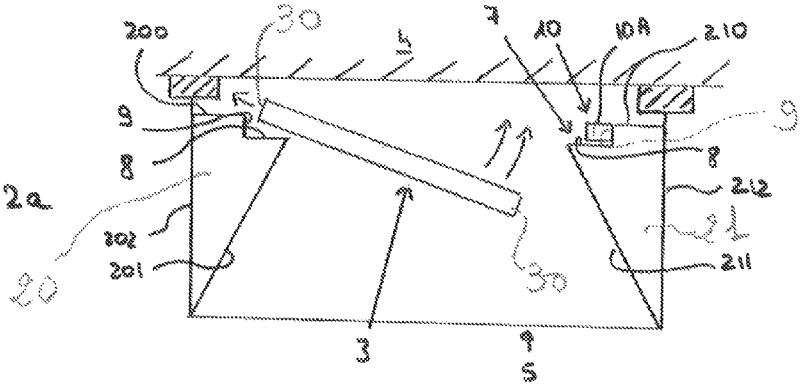
FIGS. 2*a* and 2*b* show the steps for placing a panel on the bearing structure to form the false ceiling shown in FIG. 1.

Panel 3 is then inserted into the space between ceiling 4 and bearing structure 2 through the access opening at an angle as shown in FIG. 2*a*.

Figure 2B:
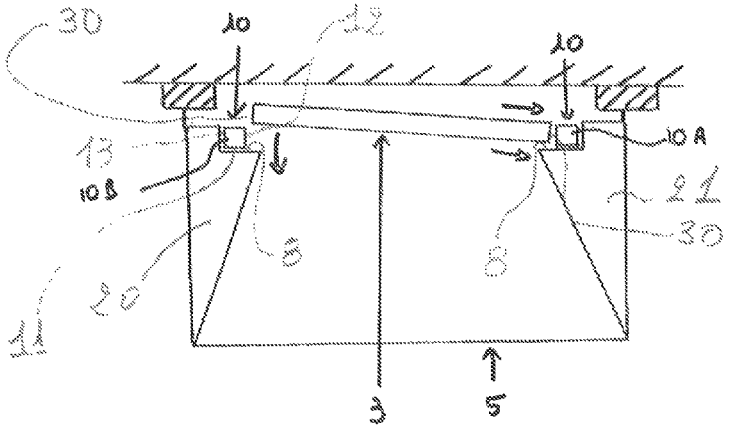

When panel 3 is sufficiently raised in space, it is pivoted upwards, leaning on the free inner peripheral edge of the horizontal bearing surface 8 (pivoting about the axis formed by the peripheral edge) to place it in a substantially horizontal position, then sliding it towards the wedge bar 10A previously installed on profile 21 (FIG. 2*a*: movement of the arrows on the right; FIG. 2*b*: movement of the arrows on the right).

The side 30 of panel 3 opposite the 10A wedge bar is then lifted above the bearing structure 2 in order to install second wedging means consisting here of a second 10B wedge bar on the horizontal bearing surface 8 of profile 20. Once the second 10B wedge bar is installed, the 30 side of panel 3 is lowered to rest on the associated horizontal bearing surface 8 (FIG. 2*b*: movement of the arrow to the left).

It is understood that the same procedure will be used, but in the opposite direction, to remove panel 3 from support structure 2.

Thus, to proceed with the installation of a panel or slab 3 in one or more parts, the installer may have a set of wedging means in the form, for example, of a set of wedging bars, possibly of different dimensions (length and cross section), which he uses according to the method described above.

The invention is described in the above as an example. It is understood that the skilled person is able to carry out different variants of the invention without going beyond the scope of the invention.

Thus, for example, each panel 3 can be made up of several elements, for example adjacent slabs, but all of the same transverse width.

Similarly, each wedge bar can be in one piece over the entire required length, or in several elements placed adjacent to each other and in the longitudinal extension of each other.

The invention claimed is:

1. A false ceiling comprising a bearing structure comprising at least two coplanar and mutually parallel opposite profile members fixed to a ceiling, the profile members defining an access opening between the profile members, the access opening providing access to the ceiling, each profile member comprising a shoulder defining a horizontal bearing surface facing towards the ceiling, at least one panel positioned between the profile members, the panel being dimensioned to rest on the bearing surface of the profile members by gravity, the false ceiling further comprising removable and attached wedging means for transversely wedging the panel between two opposite profile members, the wedging means being arranged on either side of the panel, wherein the wedging means are arranged to define with the panel a clearance, said clearance allowing the installation of the panel on the profile members, and the panel being removable by pushing while preventing transverse movement of the panel towards one of the profile members with a risk of disengagement at the opposite profile member.

2. The false ceiling according to claim 1, wherein the wedging means are mounted so as to be vertically supported by the bearing surfaces of the profile members.

3. The false ceiling according to claim 1, wherein each wedging means is transversely interposed between a side edge of the panel and a vertical bearing surface of an associated profile member facing towards the opposite profile member.

4. The false ceiling according to claim 3, wherein the panel has a width greater than a width of said access opening, and in that the wedging means have a nominal transverse width set according to the width of the panel and the width of the access opening so as to prevent any transverse displacement of the panel such that one of the side edges of the panel is positioned opposite the access opening.

5. The false ceiling according to claim 1, wherein each wedging means is a wedge bar, an elongate body of which is vertically supported along a bearing surface of an associated profile member, and which is transversely interposed between a side edge of the panel and a vertical bearing surface of the associated profile member facing towards the opposite profile member.

6. The false ceiling according to claim 5, wherein the wedge bar has at least one elongate planar lower face adapted to be supported along a bearing surface of an associated profile member.

7. The false ceiling according to claim 6, wherein the wedge bar has a rectangular or square cross-section so as to comprise two opposite elongate planar side walls adapted to be interposed transversely between a side edge of the panel and a vertical bearing surface of the associated profile member facing the opposite profile member.

8. The false ceiling according to claim 1, wherein the shoulders of the profile members define a bearing surface having a transverse width greater than or equal to 5 mm.

9. The false ceiling according to claim 1, wherein the bearing surfaces of the profile members are located at the same height.

10. The false ceiling according to claim 1, wherein the profile members, having a triangular cross-section, comprise a notch provided in the upper part, with the intersection of two faces of the notch defining the shoulder.

11. The false ceiling according to claim 1, wherein the panel is a bright panel.

12. The false ceiling according to claim 1, wherein the false ceiling comprises a stretched canvas fixed a lower part of the profile members, extending parallel to the panel.

13. A method for installing a panel on a ceiling provided with an existing structure for making a false ceiling, with the existing structure comprising at least two coplanar and mutually parallel opposite rails, the method comprising the steps of:

a) fixing a profile member on each rail, with each profile member defining with the profile member fixed to an opposite rail an opening providing access to the ceiling, wherein each profile member, has a triangular cross-section, comprises a notch provided in an upper part, with the intersection of two faces of a notch defining a shoulder, the shoulder defining a horizontal bearing surface facing towards the ceiling, b) obliquely inserting a panel having a cross-section greater than the width of the opening providing access to the space located above the profile members and delimited by the ceiling, c) positioning at least one removable wedging means attached to a bearing surface of one of the profile members, and d) positioning the panel on the bearing surfaces.

14. The method according to claim 13, wherein step c) of positioning is performed before or after the step b) of inserting.

15. The method according to claim 13, further comprising:

e) positioning at least another removable wedging means attached to a bearing surface of the other profile member.

* * * * *